United States Patent [19]

Gibson

[11] 4,319,791

[45] Mar. 16, 1982

[54] PROTECTIVE CAGE FOR EXCAVATION WORKERS

[76] Inventor: Van A. Gibson, 6510 SE. Jack Rd., Milwaukie, Oreg. 97222

[21] Appl. No.: 44,921

[22] Filed: Jun. 4, 1979

[51] Int. Cl.[3] ..... A45F 3/44; E21D 5/12; F16M 13/00

[52] U.S. Cl. ..... 312/239; 405/283; 248/156; 248/544

[58] Field of Search ..... 312/239; 405/283, 284; 248/156, 544, 545; 49/50, 55; 16/86 C; 292/259

[56] References Cited

U.S. PATENT DOCUMENTS

| | | | |
|---|---|---|---|
| 597,825 | 1/1898 | Schwaabe | 49/55 |
| 1,114,510 | 10/1914 | Owens | 292/259 |
| 2,633,713 | 4/1953 | Shields | 405/283 |
| 2,777,294 | 1/1957 | Rosa et al. | 405/283 |
| 2,866,320 | 12/1958 | Bazzell | 405/283 |
| 3,074,583 | 1/1963 | Martinich, Jr. | 248/156 |
| 3,204,415 | 9/1965 | Hill, Jr. et al. | 405/283 |
| 3,543,522 | 12/1970 | Torti | 405/283 |
| 3,818,709 | 6/1974 | Gibson | 405/283 |
| 3,922,866 | 12/1975 | Benning | 405/283 |
| 4,061,301 | 12/1977 | Catena | 248/545 |

*Primary Examiner*—Victor N. Sakran
*Attorney, Agent, or Firm*—Eugene M. Eckelman

[57] ABSTRACT

A box-like housing has defining sides and a top wall all arranged to provide protection for an excavation worker in the housing from cave-ins of the walls of the excavation. The bottom of the housing is open and such housing has downwardly extending legs arranged to support it a spaced distance off the bottom of an excavation to allow the worker to dig out beyond the sides of the housing. Each of the legs has a ground engaging member to support the housing on the bottom of an excavation and an extension arranged to pierce the ground and anchor the housing against lateral movement. The housing has a lift connection for a powered lifting device on an upper portion thereof. Multiple doorways are provided with safety chains to hold them shut in the event of a cave-in. A seat for supporting a worker when the cage is being moved is suspended in the housing.

3 Claims, 6 Drawing Figures

PROTECTIVE CAGE FOR EXCAVATION WORKERS

FIELD OF THE INVENTION

This invention relates to new and useful improvements in protective cages for excavation workers and the like.

SUMMARY OF THE INVENTION

According to the present invention and forming a primary objective thereof, a protective cage is provided for excavation workers having a novel construction facilitating efficient usage and at the same time being arranged to be handled by a power lifting device such as a back hoe or other power device usually found on construction projects.

In carrying out the invention, a box-like housing has defining sides and a top wall all arranged to provide protection for a worker in the housing from cave-ins. The bottom of said housing is open, and leg means are provided to support the housing a short distance above the ground so that the worker can dig out beyond the sides of the housing. Lift connecting means are provided at the top of the housing for releasable attachment to powered devices arranged to move the cage into and out of as well as in the excavation. Seat means are suspended from a central portion of the housing to support safely a worker at the time the housing is being moved. Multiple access means are provided around the housing each of which has interior safety chains arranged to hold the door shut in the event of a cave-in.

The invention will be better understood and additional objects and advantages will become apparent from the following description taken in connection with the accompanying drawings which illustrate a preferred form of the device.

DETAILED DESCRIPTION OF A PREFERRED EMBODIMENT

Figures 1, 2:
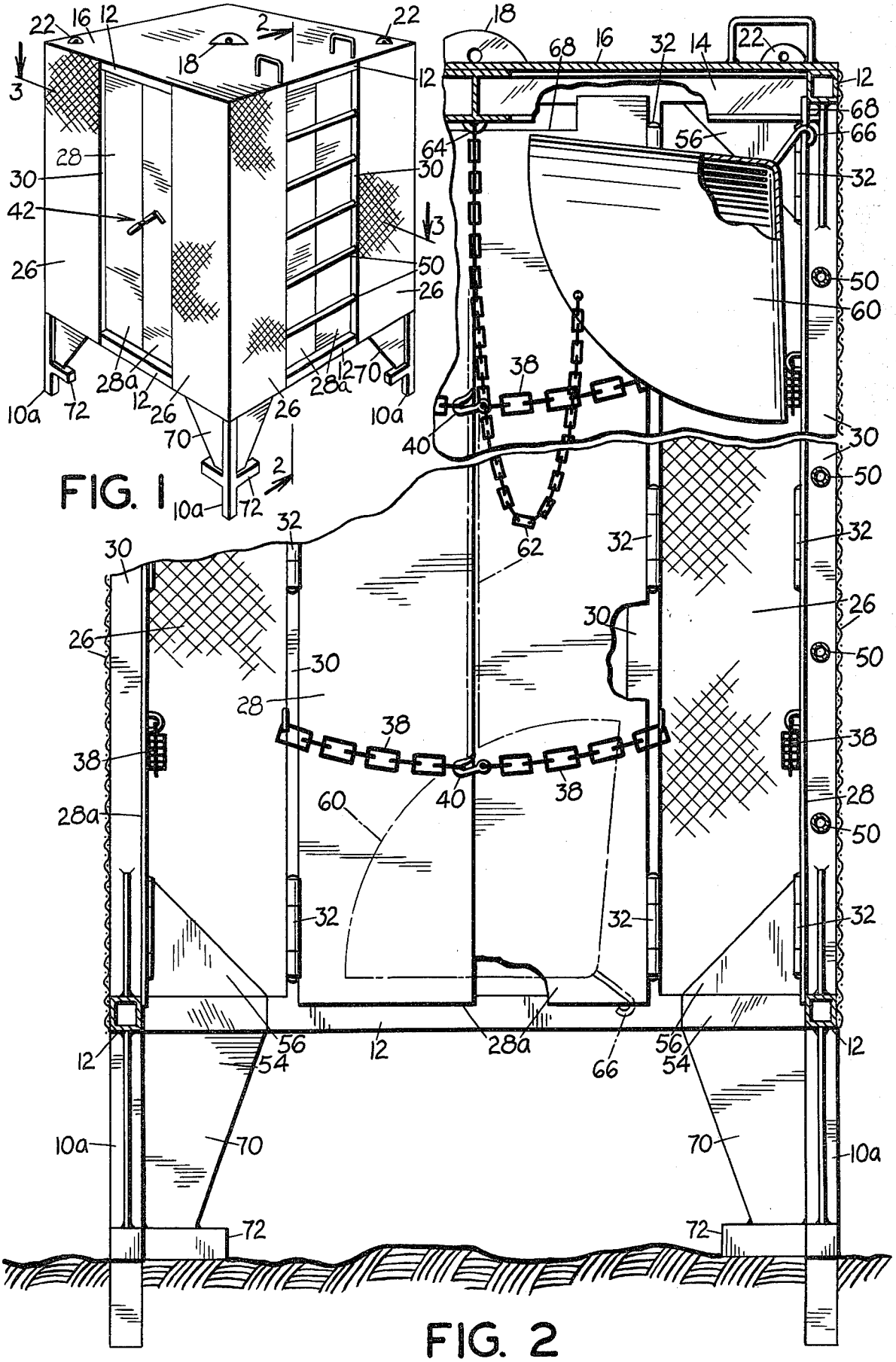
FIG. 1 is a perspective view of a protective cage embodying features of the present invention.
FIG. 2 is an enlarged, foreshortened sectional view taken on the line 2—2 of FIG. 1, a portion of this view being broken away.
Figure 3:
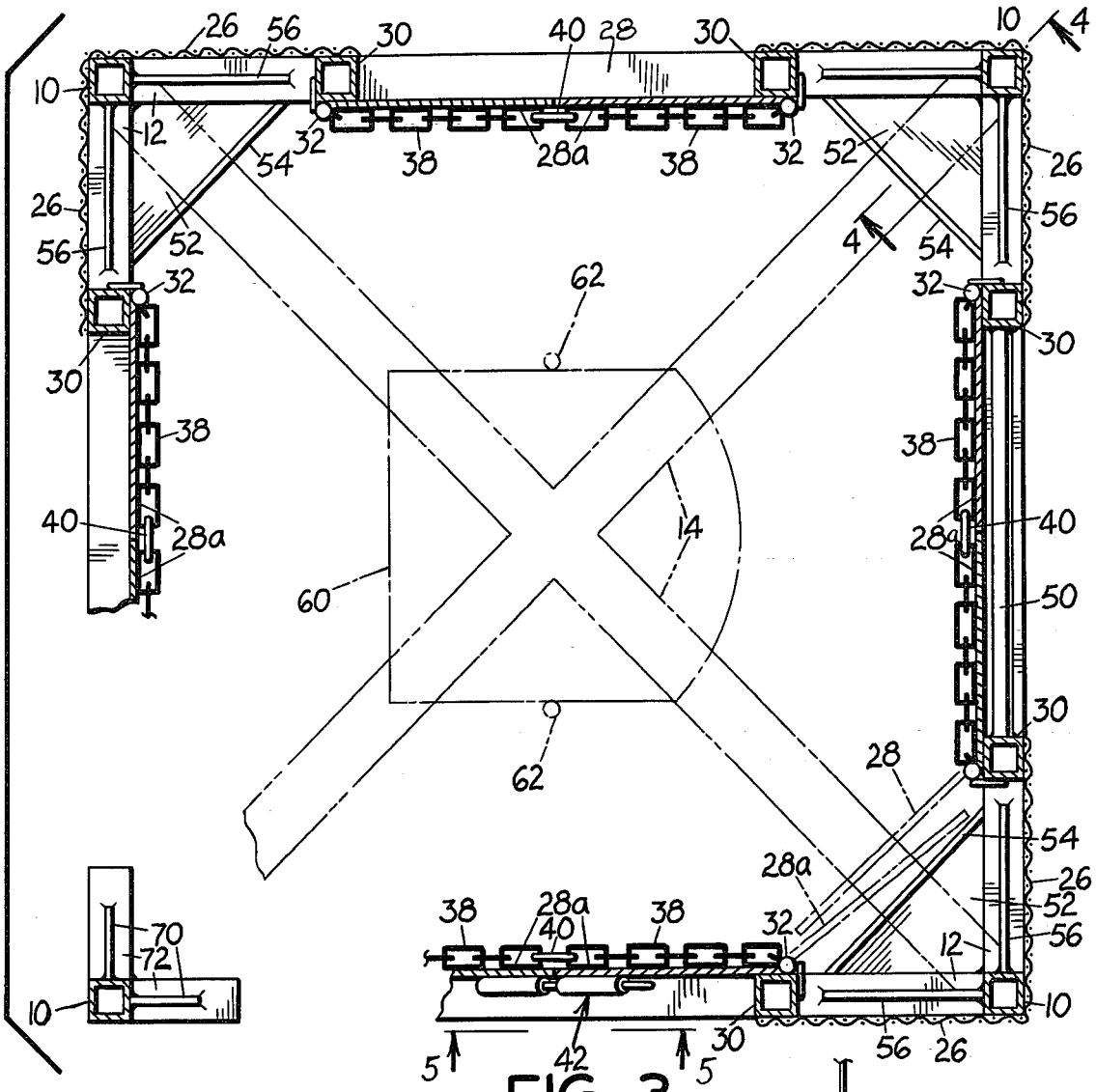
FIG. 3 is an enlarged horizontal sectional view taken on the line 3—3 of FIG. 1, a portion of this view also being broken away.
Figure 6:
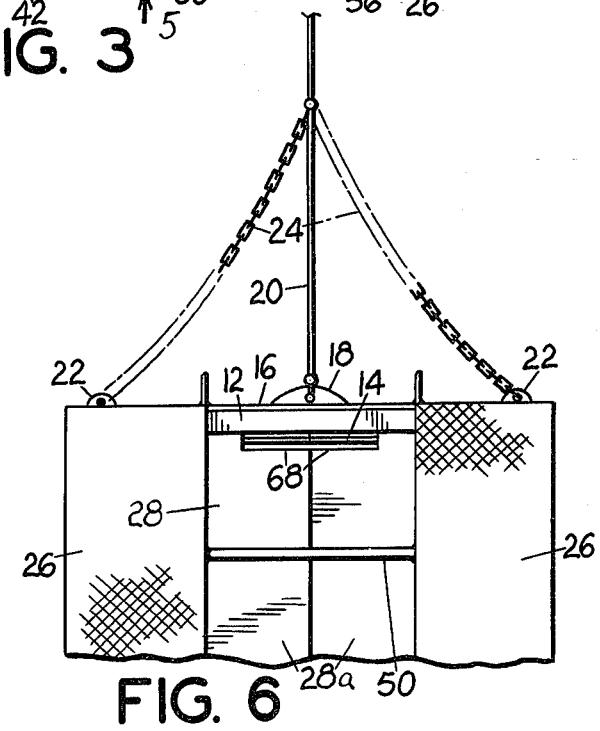
FIG. 6 is a fragmentary elevational view taken from one side of the housing and showing lift means in engaged position.

With particular reference to the drawings and first to FIGS. 1, 2 and 3, the protective cage of the invention includes a sturdy framework consisting of vertical corner frame members 10 joined to form a rectangular housing by upper and lower horizontal frame members 12 on all sides. The upper end of the housing has diagonal I-beams 14 and a top steel plate 16 secured integrally to the I-beams, as by welding. A central lift eye or other suitable connecting member 18 is secured integrally to the top plate 16, as by welding, and is arranged to have releasable connection with a lift line 20, FIG. 6, from a power lifting device such as a back hoe, crane or the like. The top plate 16 also has a pair of additional eyes 22 at diagonal corners arranged for connection to safety chains 24 connected to the lift line. The bottom of the housing is open.

The housing has side walls 26 each comprising a central doorway 28 consisting of a pair of hinged panels 28*a* connected to intermediate vertical frame members 30 by hinges 32, these panels opening inwardly to corner folded positions as shown in broken lines in FIG. 3. The area between the doors is covered by expanded metal panels.

Figure 5:
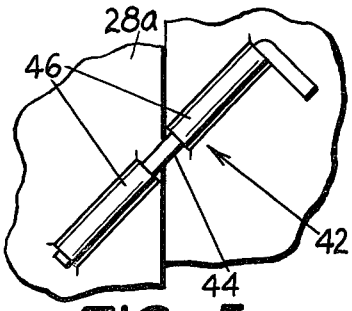
FIG. 5 is an enlarged fragmentary elevational view taken on the line 5—5 of FIG. 3.

Upper and lower safety chains 38 are associated with each door, these chains being connected at their ends to the vertical frame members 30 and having a central releasable hook portion 40. These chains can be hooked in place when the worker is inside to insure that the doors will remain shut in the event of a cave-in. An outside latch 42, best seen in FIGS. 1 and 5 and consisting of a locking rod 44 having slidable engagement with a pair of receptacle latch portions 46, is provided on one door to lock this door from the outside after the worker has locked the other doors by means of the chains 38 and exited from the cage. One door is also provided with ladder rungs 50 secured between the vertical frame members 30 of that door and arranged to provide access to the top of the cage for hooking and unhooking a lifting line and safety chains. These rungs are widely spaced to allow a worker to crawl between them if necessary.

Figure 4:
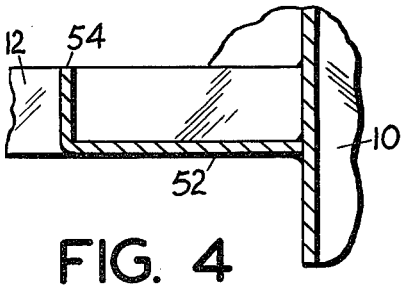
FIG. 4 is an enlarged fragmentary sectional view taken on the line 4—4 of FIG. 3.

As best seen in FIGS. 3 and 4, corner portions of the frame have horizontal webs 52 and front vertical webs 54 which serve a first purpose of reinforcing the corner portions of the frame and a second purpose of forming pockets in which the worker may place or stand tools when not in use. Reinforcing gussets 56 are provided at corner portions as necessary.

A bucket-type seat 60 is provided interiorly of the housing and is connected to a pair of side chains 62 secured at a common eye 64 integrated with a central portion of the I-beams 14. The seat is used by the worker for safe support in the housing when the latter is being moved into and out of an excavation or also while it is being moved within the excavation. The use position of the seat is shown in broken lines in FIG. 2 and a storage position of the seat is shown in full lines in this same figure. For the purpose of storage, the seat has a hook 66 at the rear bottom portion thereof arranged to hook over the top of a door panel 28*a*. The door panels have top notches 68 which are provided to allow clearance with the I-beams 14, and the hooks 66 are arranged for engagement over these notched portions.

Corner frame members 10 have bottom leg extensions 10*a* reinforced by vertical gussets 70 and having integral foot members 72 spaced below the housing but above the bottom end of the extensions 10*a*, the gussets 70 also being secured to the foot members 72. These foot members are arranged to engage the surface of the excavation floor, as seen in FIG. 2, to support the cage on such excavation floor. The projections of the leg extensions 10*a* below the foot members 72 pierce the ground and anchor the cage against lateral movement. The spacing of the foot members 72 from the bottom frame members 12 is preselected so that a suitable working space can be provided under and beyond the sides of the housing. Thus, suitable protection is provided for the worker but at the same time he is not limited to the specific dimensions of the cage.

In the use of the cage, the worker supports himself in the seat in its suspended position during those times that the cage is moved into or out of the excavation. The worker can also support himself in the seat when the cage is being moved to a new position within the excavation. When the worker is working in the cage, he can hook the seat to the upper portion of one of the doors as shown at FIG. 2.

The cage is designed to be used on substantially all construction projects in that it can be handled readily by back hoes or the like which are usually available on construction projects. The multiple doorways provide suitable exit and generally at least one of such doorways is clear for exit in the event of a cave-in. In view of the elevated support of the housing of the cage, a worker can cover a large area outside of the cage. The cage is compact and of minimum weight and thus readily portable by the average contractor.

It is to be understood that the form of my invention herein shown and described is to be taken as a preferred example of the same and that various changes in the shape, size and arrangement of parts may be resorted to without departing from the spirit of my invention or the scope of the subjoined claims. For example, two or more seats may be used instead of the one illustrated. Such seat or seats are located in the cage for good balance of the latter.

Having thus described my invention, I claim:

1. A protective cage for excavation workers comprising (a) a box-like housing having defining side walls therearound and a top wall all arranged to provide an interior which serves as an enclosed protective area for a worker in the housing from cave-ins or the like in an excavation, (b) said housing having an open bottom portion to provide a digging area under said housing interior when said housing is seated on the ground in an excavation, (c) a plurality of legs on said houing extending downwardly below the bottom thereof, (d) a flat ground engaging portion on each of said legs spaced below the bottom of said housing for supporting said housing on supporting ground with the bottom thereof spaced above the supporting ground to allow a worker to dig under as well as out beyond the sides of said housing, (e) extensions on said legs projecting below said ground engaging portions arranged to pierce the ground and anchor said housing against lateral movement, (f) at least two door means spaced around said defining side walls and hinged for inward movement, (g) releasable safety chain means extending across said door means interiorly of said housing to hold said door means shut in the event of a cave-in, (h) and a lift connection on the upper portion of said housing for moving said housing into and out of as well as within an excavation by a powered lifting device.

2. The protective cage of claim 1 including ladder rungs on said housing extending across the outer side of at least one of said door means and providing an outside climbing access to the top of said housing, at least some of said rungs being spaced sufficiently apart to allow a worker to exit therebetween.

3. The protective cage of claim 1 incuding a seat in said housing for supporting a worker when the cage is being moved into and out of or within an excavation, and flexible means suspending said seat substantially centrally of said housing for lateral balance of the latter.

* * * * *